US006283352B1

(12) United States Patent
Messner et al.

(10) Patent No.: US 6,283,352 B1
(45) Date of Patent: Sep. 4, 2001

(54) APPARATUS FOR A STEPWISE FEEDING OF A STRIP-LIKE WORKPIECE

(75) Inventors: Helmut Messner, Arbon; Andrea Molinari, Gossau, both of (CH)

(73) Assignee: Bruderer AG, Egnacherstrasse (CH)

( * ) Notice: Subject to any disclaimer, the term of this patent is extended or adjusted under 35 U.S.C. 154(b) by 0 days.

(21) Appl. No.: 09/388,915

(22) Filed: Sep. 1, 1999

(30) Foreign Application Priority Data

Nov. 20, 1998 (EP) ..... 98122037

(51) Int. Cl.[7] ..... B65H 23/06
(52) U.S. Cl. ..... 226/149; 226/151; 226/161
(58) Field of Search ..... 226/149, 151, 226/162, 161, 167

(56) References Cited

U.S. PATENT DOCUMENTS 4,040,553 8/1977 Gotz ..... 226/151
4,552,294 * 11/1985 Rotzler ..... 226/149 X
4,776,505 * 10/1988 Kato ..... 226/149 X
4,792,074 12/1988 Bareis et al. ..... 226/149
4,819,850 4/1989 Kato ..... 226/162
5,163,595 * 11/1992 Messner ..... 226/149 X
5,358,164 * 10/1994 Messner ..... 226/142
5,632,430 * 5/1997 Kato ..... 226/149

FOREIGN PATENT DOCUMENTS 4141769 6/1993 (DE) .

* cited by examiner

*Primary Examiner*—Michael R. Mansen
(74) *Attorney, Agent, or Firm*—Ladas & Parry

(57) ABSTRACT

A first clamping member allocated to the feeding of the web co-operates with a second clamping member allocated to the feeding of the web in order to clamp the web for a feeding thereof. The first clamping member is controlled by a cam disk via lever arm members. A first arresting member co-operates with a second arresting member in order to clamp the web for an arresting thereof. The first arresting member is controlled from the same cam disk via lever control members.

5 Claims, 6 Drawing Sheets

APPARATUS FOR A STEPWISE FEEDING OF A STRIP-LIKE WORKPIECE

BACKGROUND OF THE INVENTION

1. Field of the Invention

The present invention relates to an apparatus for a stepwise periodic feeding of a strip-like workpiece, having a first pressing member adapted to periodically exert a pressure onto the workpiece, further having a second, periodically driven pressing member which co-operates with the first pressing member, which two pressing members are adapted to receive the strip-like workpiece between themselves for a periodic clamping and feeding of same, and having a periodically moveable first arresting member which is adapted to periodically press the strip-like workpiece against a second arresting member in order to temporarily arrest the strip-like workpiece.

2. Description of the Prior Art

Apparatuses for a stepwise periodic feeding of a strip-like workpiece are used together with presses in which presses a variety of tools for a working or processing, respectively of a strip-like workpiece can be mounted. Such a press is commonly called in the art punch press. The stepwise feeding of the strip-like workpiece to be worked upon or processed, respectively in the punch press proceeds either by oscillating rollers or by tongs. For a feeding movement the strip-like workpiece is clamped between two rollers or by the tongs. In designs having rollers, the rollers rotate in an oscillating manner through a predetermined angle to and fro around their longitudinal axes. In designs having tongs an oscillating rectilinear movement to and fro of the tongs is performed. In order to perform the feeding movement of the strip-like workpiece or web, respectively, it is clamped between the rollers or tongs, respectively, and is advanced. After the advancing movement has been terminated the clamping is released and the rollers or tongs, respectively, return to their initial position. In order to keep the web arrested during this return movement it is clamped by arresting members, generally by a vertically moveable clamping bar which clamps the web against a counter member in order to keep it arrested. Furthermore, in order to prevent an adding up of small feeding errors such to prevent a detrimental influence regarding the precision of the article produced by the working of the web, so-called guiding pin holes are punched e.g. during each process step, such as a punching into the striplike web, whereby immediately prior to each process step, e.g. a punching operation, the strip-like workpiece is guided and located precisely by positioning pins which enter into the guiding pin holes such that the tools of the punch press can process the web with a sufficient precision. As long as the string-like web is arrested by the guiding pins, neither the feeding members nor the arresting members are allowed to act onto the strip-like web, all these members are lifted off the strip-like web during the processing or working, respectively phase, which state of operation is called intermediate lifting.

The driving of the oscillating feeding rollers or tongs, respectively, takes place such as generally known by means of a crank drive arrangement or an oscillating cam drive apparatus.

In the case of known feeding apparatuses having a crank drive, a sine-like motion of the feeding movement occurs during a movement of the crank angle through 180°, whereby at the end positions of the movement a "momentary standstill" and maximal acceleration occurs.

Other designs of feeding apparatuses comprise an oscillating cam drive in order to produce the feeding movement, i.e. the movements of the rollers or tongs, respectively. The advantage of an oscillating cam drive is that the angle of feed can be selected to be larger or less than 180°, because contrary to a crank drive the motion in the oscillating cam drive can be variously selected.

Accordingly, an arbitrarily long standstill of the feeding members of an acceleration of 0 can be set at the end position of the feeding movement. The flexibility of the selecting of the movement of the feeding members can doubtlessly be increased therewith, but the performance of the feed will be lessened accordingly, because a standstill of a more or less long duration during the end phases of the feeding movement takes place.

At known feeding apparatuses having an oscillating cam drive the periodic movements, at the one hand of the feeding members, i.e. rollers or tongs, and at the other hand the arresting members, thus the clamping bar with the counter member are each controlled by a separate cam drive. Because now the course of their movements differ from each other they must be precisely co-ordinated among themselves, whereby at the end positions of the feeding movement a standstill of the rollers or tongs, respectively, and an acceleration of 0 must be present. Such a standstill leads to a corresponding reduction of the performance of the feeding and accordingly to a corresponding reduction of the output of the production when processing a respective web-shaped workpiece.

A curve generated by the guiding members of an oscillating cam drive which corresponds to the curve generated by a crank drive (sine movement) with a "momentary standstill" and maximal acceleration in the end positions is not possible.

SUMMARY OF THE INVENTION

Hence, it is a general object of the invention to provide an apparatus for a step-wise, periodic feeding of a strip-shaped workpiece in which the pressing member which is allocated to the performing of the feeding movement and the arresting member are driven by merely one cam drive, such that at an oscillating cam drive a momentary standstill with a maximal acceleration is possible in its end positions.

A further object is to provide an apparatus for a stepwise periodic feeding of a strip-like workpiece, having a first pressing member adapted to exert periodically a pressure onto the workpiece, further having a second, periodically driven pressing member which co-operates with the first pressing member, which two pressing members are adapted to receive the strip-like workpiece between themselves for a periodic clamping and feeding of the workpiece, and having a periodically moveable first arresting member which is adapted to periodically press the strip-like workpiece against a second arresting member and to momentarily arrest the strip-like workpiece, which apparatus includes a drive shaft and an oscillating cam drive apparatus arranged longitudinally displaceable on the drive shaft, which oscillating cam drive apparatus is drivingly connected to at least the second pressing member, and includes one single cam disk which is firmly connected to the drive shaft, which cam disk is drivingly connected via a transmitting linkage arrangement to the first pressing member and to the first arresting member, as well, whereby the periodic movement for exerting a pressure by the first pressing member and the periodic movement for a clamped arresting by the first arresting member are controlled by said one single cam disk.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE PREFERRED EMBODIMENTS

Figure 1:
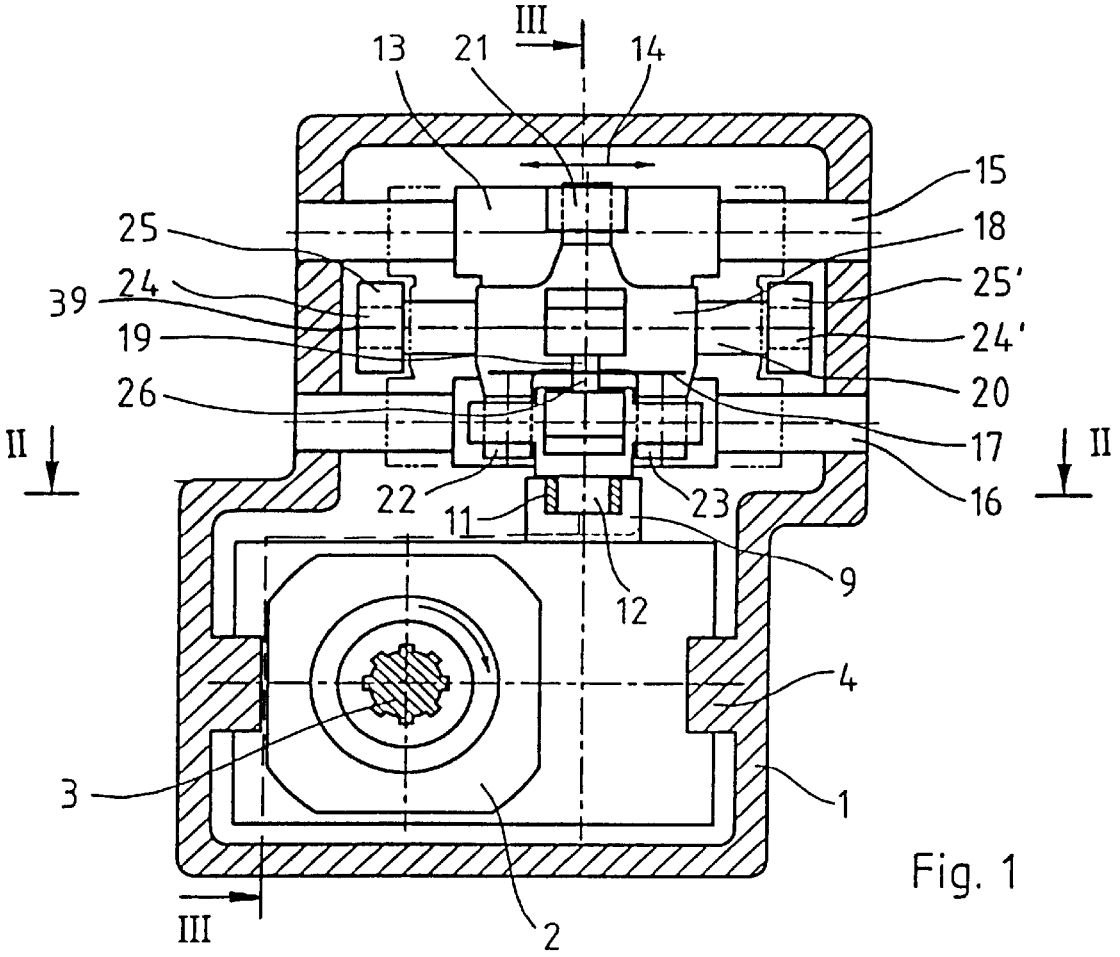
FIG. 1 illustrates a section along line I—I of FIG. 2 through a web feeding apparatus having web feeding tongs.
Figure 2:
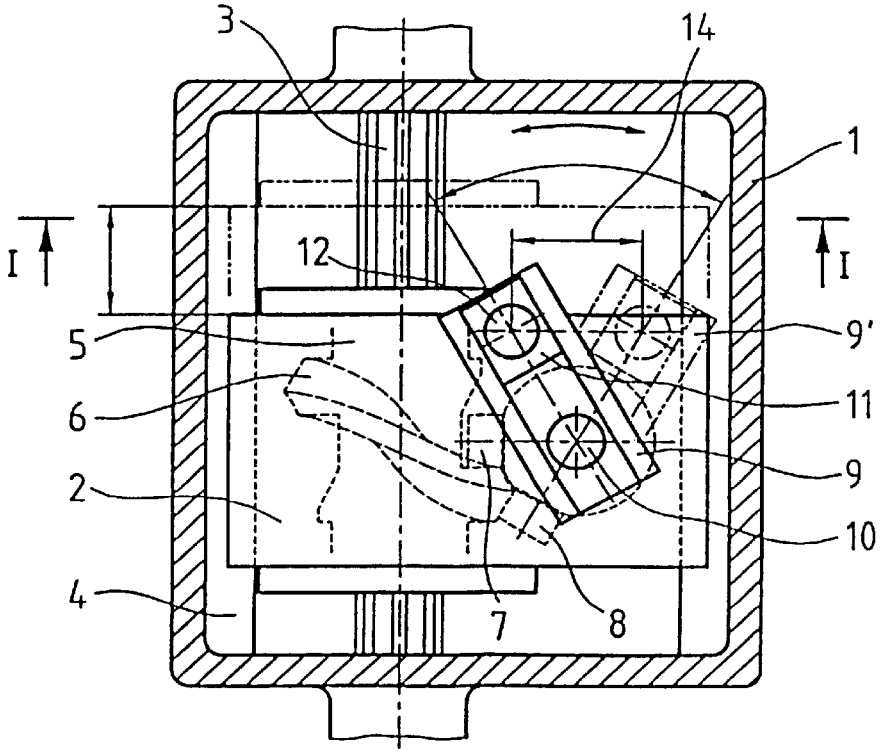
FIG. 2 illustrates a section along line II—II of FIG. 1 through a web feeding apparatus having web feeding tongs.

An oscillating cam drive apparatus 2 is located in the housing 1 of the web feeding apparatus. This oscillating cam drive apparatus 2 is driven by a shaft 3 which is designed as a multi-key shaft. The oscillating cam drive apparatus 2 is supported on guide rails 4 in the housing 1 such to be displaceable along these guide rails 4. The cam drive apparatus 2 includes a cylinder 5 having a roller guide 6 by means of which the rollers 7, 8 are guided. These rollers 7, 8 control the position or movement, respectively of a crank 9 which is supported to pendulate on a pivot pin 10. Thus, in operation the crank 9 pendulates between the position 9 illustrated by solid lines and the position 9' illustrated by broken lines. A sliding block 11 is arranged in the crank 9. This sliding block 11 is supported for rotation on a pin 12, which pin 12 is a part of a tongs support 13.

In operation the crank 9 oscillates between the position 9 and 9' and the distance line 14 between the illustrated end positions depicts the length of feed of the tongs support 13. The tongs support 13 is supported on shafts 15 and 16 such to be oscillatingly moveable in the direction of the feeding of a web being worked upon and moves to and fro along the distance line 14, whereby the length of the distance line 14 is determined by the two end positions of the crank 9. The tongs support 13 supports the lower jaw 26 of the tongs; the web 17 to be fed rests on this lower jaw 26 of the tongs. An upper tongs support 18 with the upper jaw 19 of the tongs is supported on a further shaft 20 such to be displaceable in the direction of the feeding movement of the web. The upper tongs support 18 is supported by pins 21, 22, 23 in corresponding bore holes of the tongs support 13 such to be displaceable in the vertical direction. The further shaft 20 includes at both ends eccentric pegs 24, 24' by means of which it is supported in double arm levers 25, 25'. Thus, in operation the upper jaw 19 of the tongs moves against the lower jaw 26 of the tongs in order to clamp the web 17 located therebetween, and conversely to move away from the lower jaw 26 of the tongs to release the web 17, whereby when in the clamping position the upper jaw of the tongs and the lower jaw of the tongs are moved to and fro in the direction of the arrow 14, such to feed the web in one direction of this movement in a clamped state, and in the lifted off state to return in the opposite direction of this movement, having the web released, back into the initial position.

Figure 3:
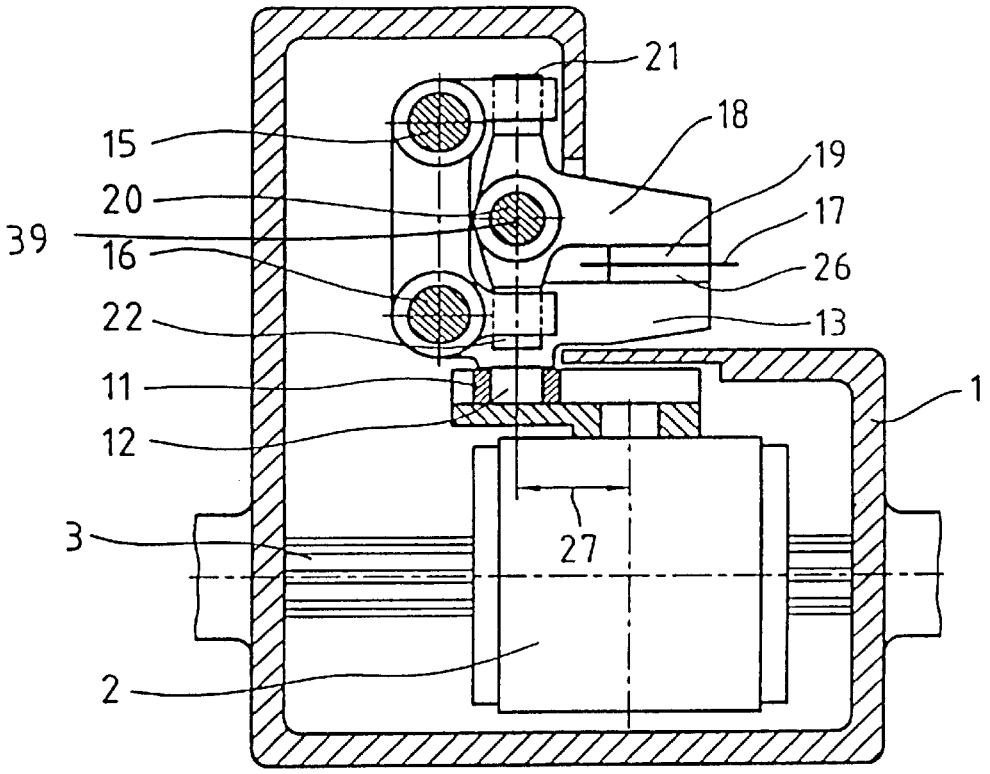
FIG. 3 illustrates a section along line III—III of FIG. 1 depicting the position of the oscillating cam drive apparatus at a maximal length of feed.
Figure 4:
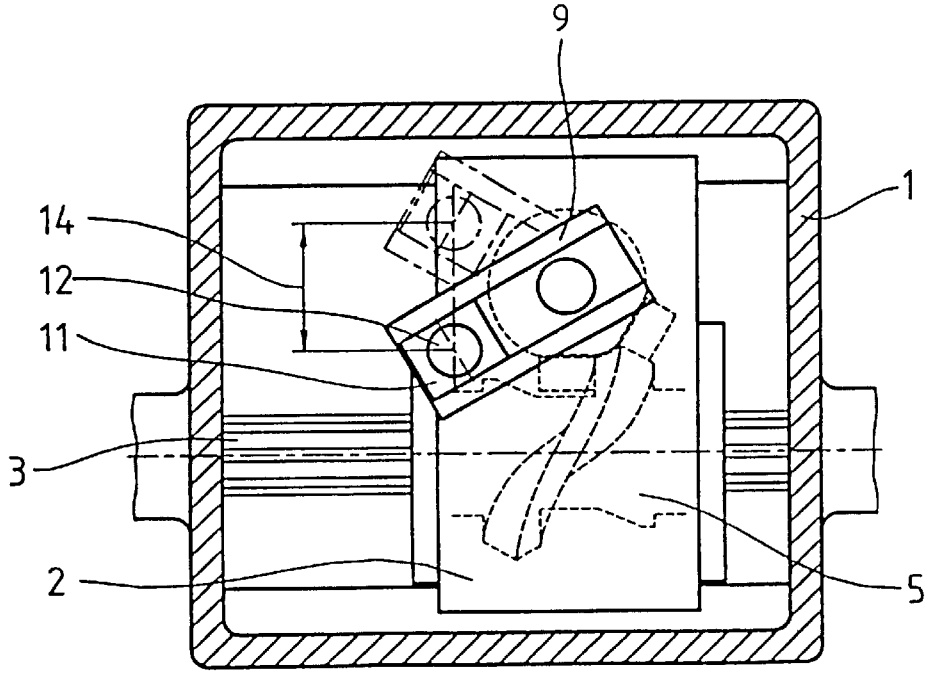
FIG. 4 illustrates a section along line II—II of FIG. 1 depicting the position of the oscillating cam drive s apparatus at a maximal length of feed.
Figure 5:
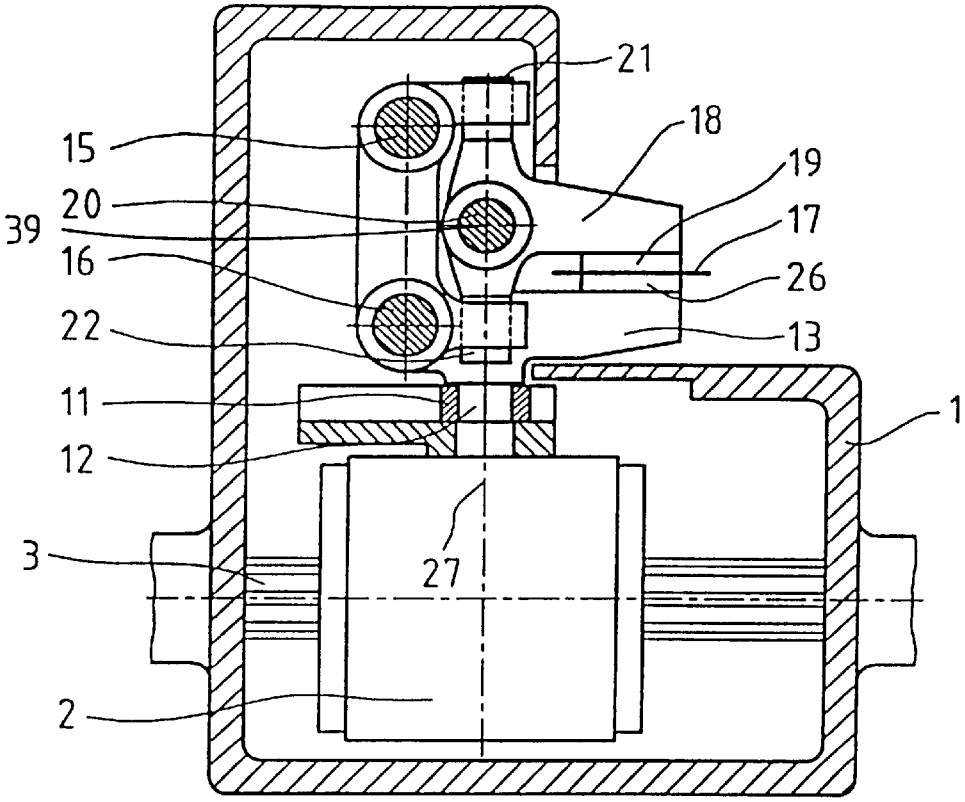
FIG. 5 illustrates a section along line III—III of FIG. 1 depicting the position of the oscillating cam drive apparatus at a length of feed of 0.
Figure 6:
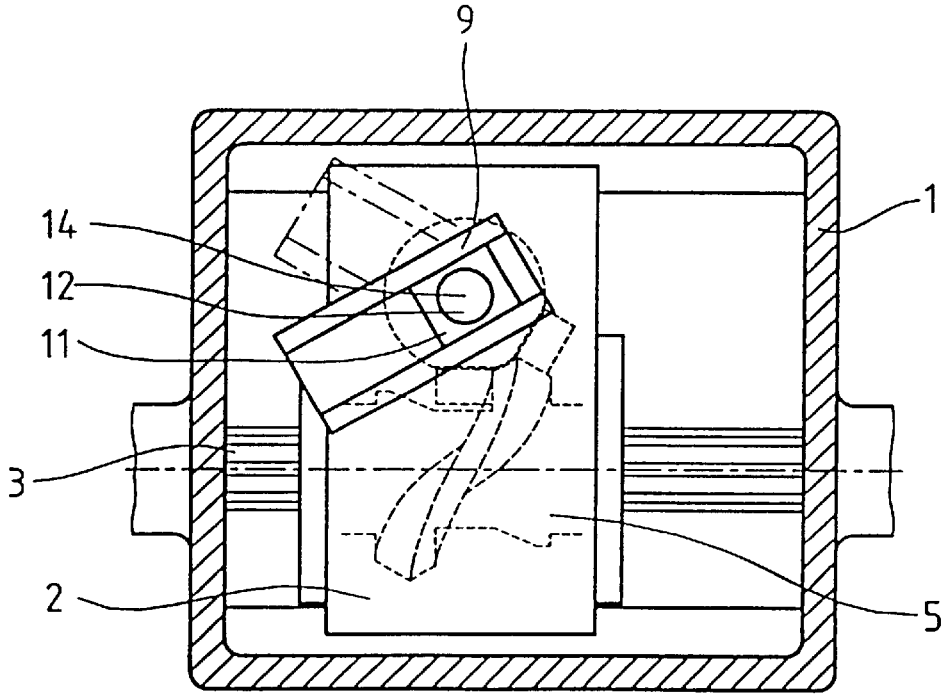
FIG. 6 illustrates a section along line II—II of FIG. 1 depicting the position of the oscillating cam drive apparatus at a length of feed of 0.

The extent of the adjustable path of the movement of the oscillating cam drive apparatus 2 within the housing 1 along the shaft 3 is depicted in FIG. 3 by the reference numeral 27. In the position of the oscillating cam drive apparatus 2 illustrated in FIGS. 3 and 4 a finite length of feed is present. For reason of comparison attention is drawn to the FIGS. 5 and 6, in which the position of the oscillating cam drive apparatus 2 defines a length of feed having the value 0, because the center axis of the pin 12 in the sliding block 11 coincides with the center axis of the pivot pin 10.

Now, the transmitting linkage and its operation will be described in order to explain the operation of the web feeding apparatus. It is here to be noted that as is generally known some linkage members are present in duplicate, i.e. arranged in a fork-like manner side by side whereby a respective structural member, e.g. upper tongs support, clamping bar, etc. is supported between two such linkage members. One single cam disk 52 is located on the shaft 3. A roller 28 is biased by a spring 29 against the cam disk 52. The roller 28 is supported in an angle lever 30 which is supported to pivot around a pivotal point 31, i.e. a pin. A first link member 32 is pivotally mounted to the end of the angle lever 30 at a point remote from the roller 28. This first link member 32 is pivotally mounted at a first pivotal point 33 to a main arm 34 of the transmitting linkage. A second link member 35 is pivotally mounted at a second pivotal point 36 to the main arm 34. This second pivotal point 36 is located at a first distance a (see FIG. 8) from the first pivotal point. The second link member. 35 is pivotally mounted to a first double arm lever 25 at a third pivotal point 37. Attention is hereto drawn to FIG. 1. Regarding the structural design two arms 25, 25' are present, whereby for reasons of the explanation only one double arm lever 25, here the double lever 25 is illustrated in the drawings 7 to 11. This first double arm lever 25 is supported at a first bearing point 38 which is located at a distance c from the third pivotal point 37. The first double arm lever 25 is mounted at a forth pivotal point 39 to the upper tongs part 19 (or upper tongs support 18 respectively). The web to be fed extends between the upper jaw 19 of the tongs and the lower jaw 26 of the tongs located thereunder. The fourth pivotal point 39 is located at a distance d from the first bearing point 38.

A third link member 40 is pivotally mounted to the main arm 34 at a fifth pivotal point 41. This fifth pivotal point 41 is located at a distance b from the first pivotal point 33. The third link member 40 is pivotally mounted to a second double arm lever 43 at a sixth pivotal point 42. This second double arm lever 43 is pivotally supported at a second bearing point 44 and mounted at a seventh pivotal point 45 to the clamping bar 46, which in certain positions clamps the web 17 against a stationary support 47. The second bearing point 44 of the second double arm lever 43 is located at a fifth distance e from the sixth pivotal point 42 and at a sixth distance f from the seventh pivotal point 45. At its end remote from the first pivotal point 33 the main arm 34 rests upon a further spring 48. A displaceable abutment 49 is located above the main arm 34 at the area of the further spring 48.

The lengths of the various described distances are selected to correspond to following equation:

$$\frac{a \times d}{c} = \frac{b \times f}{e}$$

Figure 7:
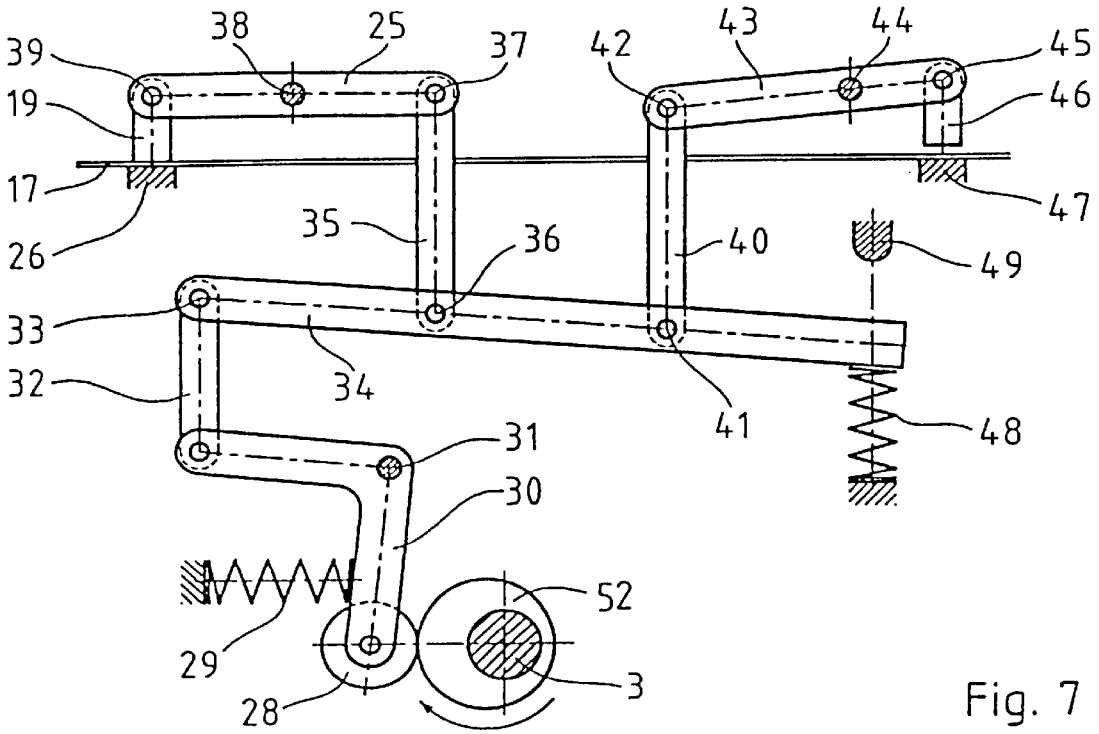
FIG. 7 illustrates schematically the transmitting linkage for a controlling of the feeding tongs and of the clamping bar, whereby the state of the web feeding apparatus is shown, during which the feeding tongs are in the clamping position and the clamping bar is in the release position.

The operation of this linkage arrangement of the web feeding apparatus works as follows:

FIG. 7 illustrates the position of the various structural members during the feeding state of the feeding apparatus. When the cam disk 52 is located in the position illustrated in FIG. 7, the angle lever 30 is pivoted in a clock-wise direction against the force of the spring 29. This pivotal movement or position, respectively of the angle lever is transmitted by the first link member 32 to the first pivotal point 33 of the main arm 34. The main arm 34 rests on the further spring 48. Thus, a pivotal movement of the main arm 34 in a clock-wise direction occurs, wherewith the second link member 35 is moved upwards (based on the illustrations of the Figures), such to cause a rotary movement of the first double arm lever 25 around the first bearing point 38. Thus, the upper jaw 19 of the tongs is lowered onto the web 17 and presses the web against the lower jaw 26 of the tongs part, such that the web is clamped and held between the upper jaw 19 of the tongs and the lower jaw 20 of the tongs. Accordingly, the clammed web 17 is fed, advanced in accordance with the pivotal movement of the crank 9 by a certain distance, the distance of feed 14 (FIG. 1). At the same time, however, the clamping or pressing, respectively bar 46 must be lifted off the web 17. During the described pivotal movment of the main arm 34 the second pivotal point 36 becomes to be a stationary fulcrum because the upper jaw 19 of the tongs rests firmly on the web 17 which is held clamped against the lower jaw 26 of the tongs. Conclusively, the third link member 40 moves downwards, such that a rotational movement of the second double arm lever 43 in a counter clock-wise sense around its bearing point 44 occurs, wherewith the pressing bar 46 is lifted off the stationary support 47 and the web is released accordingly.

Figure 8:
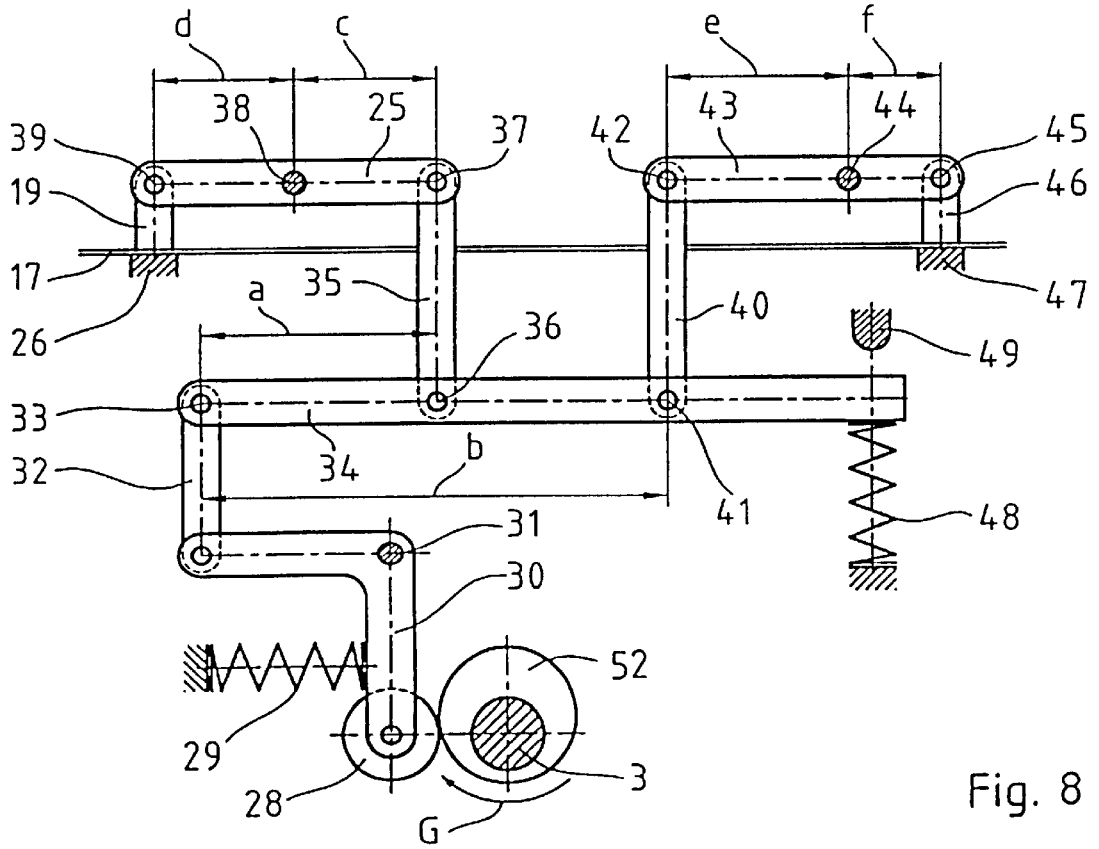
FIG. 8 illustrates schematically the transmitting linkage in the state after the feeding motion of the web has been stopped, whereby the feeding tongs and the clamping bar, as well are in the closed position.

FIG. 8 shows the position of the linkage arrangement after the feeding of the web 17 has been terminated. The cam disk 52 has rotated further in the direction of the arrow G and is now in the position as shown in FIG. 8. This position is merely a momentaneous position of a short duration. In this position the jaws 19, 26 of the tongs are in the closed position and at the same time the clamping bar 46 and the stationary support 47 are in their clamping state. Due to the above described relation of the distances a–f this state is now ensured independently of the thickness of the web 17.

Figure 9:
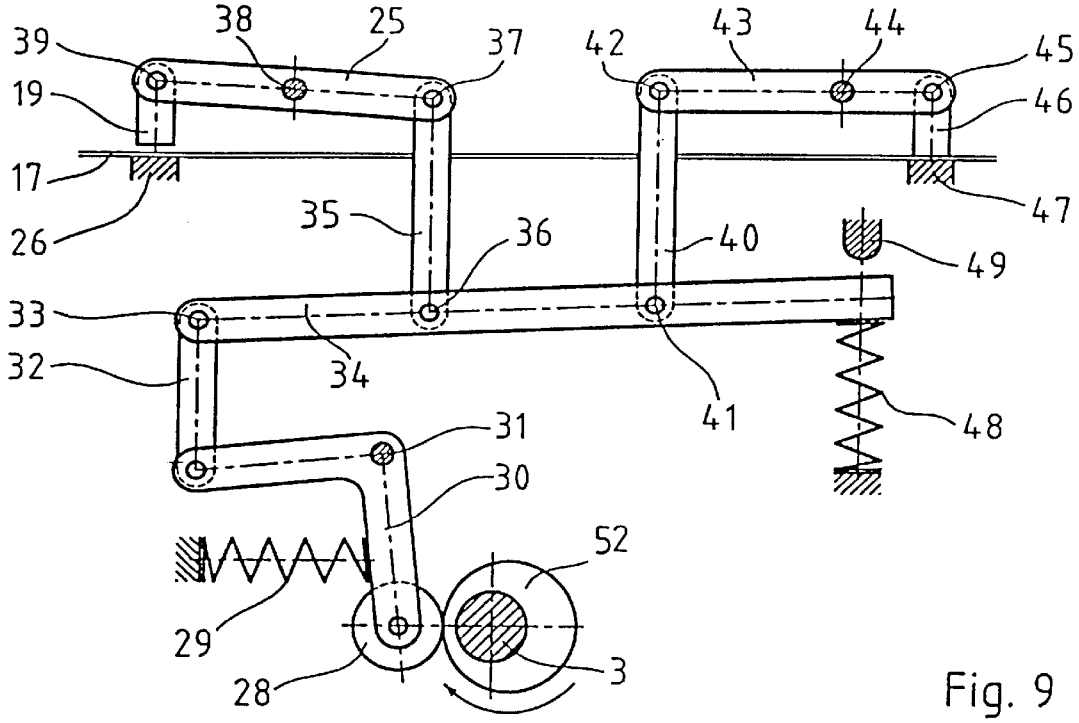
FIG. 9 illustrates schematically the transmitting linkage in the state during the return movement of the feeding tongs, during which the feeding tongs are in their open position and the clamping bar is in the closed position.

FIG. 9 illustrates the position of the individual link members of the linkage arrangement during which the jaws 19, 26 of the tongs return to their initial position.

The web 17 is held arrested by the clamping bar 46 and the stationary support 47. The spring force of the further spring 48 is transmitted via the main arm 34, the third link member 40 and the second double arm lever 43 onto the clamping bar 46, whereby now the main arm 34 is supported at the fifth pivotal point 41 around which now the main arm 34 performs a pivotal movement.

The pivoting movement of the angle arm 30 which has occurred is transmitted via the first link member 32 and the first pivotal point 33 the main arm 34. The main arm 34 pivots such as described above around the fifth pivotal point 41. This movement is transmitted by the second link member 35 to the first double arm lever 25, which thus rotates clockwise and accordingly lifts the upper jaw 19 of the tongs off the web 17. The upper tongs jaw 19 of the tongs reaches its largest open position at the position of the cam disk 27 depicted in FIG. 9.

Due to the design of the linkage arrangement the jaws 19, 26 of the tongs can be in the open position only as long as the clamping bar 46 rests on the web 17 and presses the web against the stationary support 47, that is arrests the web in a clamped state. On the other hand, the clamping bar 46 can be in the open position only as long as the upper jaw 19 of the tongs rest in a clamping manner on the web 17. Due to this reciprocal relationship caused by the linkage arrangement the movements of the upper jaw 19 of the tongs and of the clamping bar 46 can thus be controlled by merely one single cam disk 52 which is drivingly connected to the drive shaft 3 of the oscillating cam drive 2. At no instant during the movements is the web 17 in a loose state. The alternating resting of the upper jaw 19 of the tongs and of the clamping bar 46 on the web occurs without any temporal overlap.

It has been explained above that for a precise locating or positioning, respectively of the web 17 during the actual working process, e.g. punching, positioning pin holes are punched through the web by the upper tool and the positioning pins are moved into these positioning pin holes in order to correct small feeding errors in the tools themselves by such a locating or positioning, respectively. When the positioning pins are inserted into the positioning pin holes the upper jaw 19 of the tongs and the clamping bar 46 are both lifted off the web 17 during the so called intermediate lifting. This intermediate lifting occurs, by the way, only after a front, conical portion of the positioning pin has entered the positioning pin hole.

Figure 10:
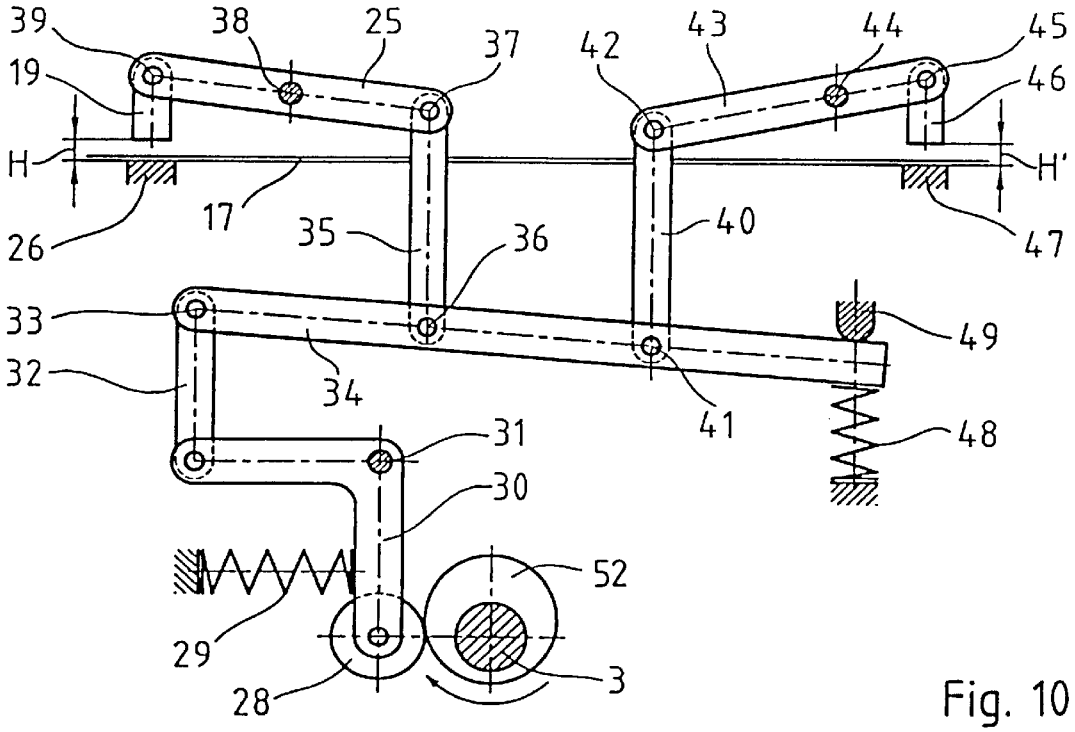
FIG. 10 illustrates schematically the transmitting linkage in the state during the centering of the web by the positioning pins in a tool, where the feeding tongs and the clamping bar, as well, are in the open position.

This position of the intermediate lifting is set by the abutment 49, whereby the time, i.e. the duration of the intermediate lifting depends from the position of the abutment 49 which can be adjusted vertically (with reference to the illustrated position). FIG. 10 depicts the position of the linkage arrangement during the intermediate lifting. The main arm 34 rests on the abutment 49 while the further spring 48 is compressed completely. Conclusively, the point of contact between the main arm 34 and the abutment 49 becomes to be the fulcrum of the main arm 34 which accordingly pivots around this fulcrum point and conclusively pulls both link members, i.e. the second link member 35 and the third link member 40 downwards, so that the two double arm levers 25 and 43 rotate around their respective bearing points with the result that the upper jaw 19 of the tongs and the clamping bar 46 are together lifted off the web 17 by the distance H and H', respectively, which web can now be precisely located or positioned, respectively by the tool of the punch press, i.e. by the positioning pins inserted in the positioning pin holes.

The feeding members of the embodiment described above are designed as tongs which move rectilinearly back and forth in the plane of feed of the web. As is generally known, there are designs with roller shaped feeding members and this embodiment will now be explained in an abridged manner with reference to FIG. 11. The linkage arrangement as such remains the same as described above, however, the upper jaw 19 of the tongs is replaced by an upper roller 50 and the lower jaw 26 of the tongs is replaced by a lower roller 51.

Figure 11:
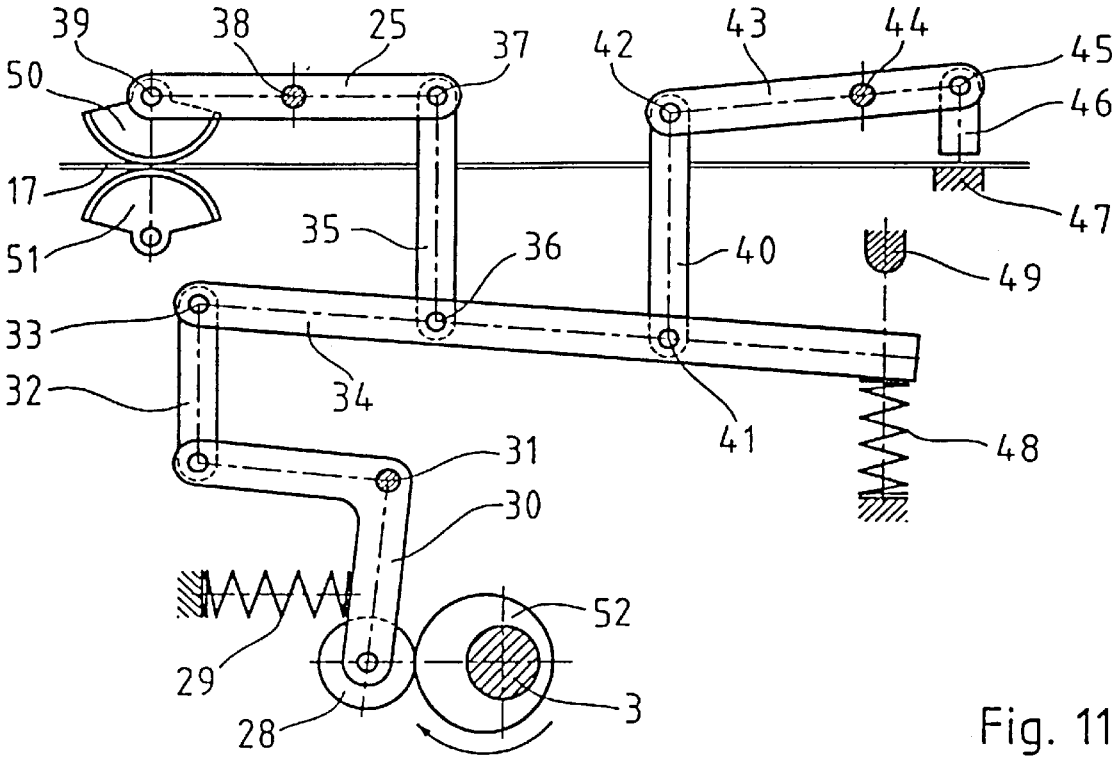
FIG. 11 illustrates schematically the transmitting linkage in a state analogue to the state shown in FIG. 7 of an embodiment having feeding rollers.

The position of the linkage arrangement illustrated in FIG. 11 corresponds to the position illustrated in FIG. 11, accordingly the feeding phase is depicted.

The upper roller 50 is supported in a freely rotatable manner in the first double arm lever 25 and is pressed by the movement of the double arm lever 25 against the web 17 or, conversely, lifted off the web.

The lower roller 51 is drivingly connected to the oscillating cam drive apparatus 2 and oscillates in the direction of feed of the web.

At the illustrated position the web 17 is held in a clamped state between the upper roller 50 and the oscillating lower roller 51 and is fed forwards due to the rotating movement of the lower roller 51. The force exerted by the further spring 48 onto the main arm 34 is transmitted by the link member 35 and the first double arm lever 25 onto the upper roller 50. In this position the main arm 34 is supported at the first pivotal point 33. The web 17 is now firmly clamped between the oscillating rollers 50, 51 and is advanced.

As soon as the upper roller 50 rests on the web 17 the second pivotal point 36 becomes obviously the fulcrum of the continued movement of the main arm 34 due to the rotational movement of the cam disk 52. The main arm 34 rotates downwards around the second pivotal point 36 and thus pulls the third link member 40 downwards wherewith the clamping bar 46 is lifted such to release the web 17. FIG. 11 depicts, thereby, the position of the cam disk 27 at the highest state of the lifted clamping bar 46.

The further phases of the feeding of the web 17, the alternating clamping and releasing of the web proceeds analogue to the description of the embodiment having the feeding tongs. The basic difference between these embodiments is merely that at the embodiment with the clamping tongs the tongs execute a linear back and forth movement in the direction of feed of the web 72, whereagainst the upper roller 50 and the lower roller 51 are stationary relative to the direction of feed of the web 17 but oscillate, however, around their axes.

While there are shown and described present preferred embodiments of the invention, it is to be distinctly understood that the invention is not limited thereto, but may be otherwise variously embodied and practised within the scope of the following claims.

What is claimed is:

1. An apparatus for a stepwise periodic feeding of a strip-like workpiece, having a first pressing member and a second, pressing member which co-operates with the first pressing member;

which first pressing member is adapted to periodically extend a pressure onto a strip-like workpiece received between the first pressing member and the second pressing member for a periodic clamping of the strip-like workpiece;

which second pressing member is driven periodically in order to periodically feed the strip-like workpiece received and clamped between the first pressing member and the second pressing member;

and having a first arresting member and a second arresting member which co-operates with the first arresting member;

which first arresting member is periodically moveable in order to press the strip-like workpiece periodically against the second arresting member in order to temporarily arrest the strip-like workpiece;

said apparatus comprising a drive shaft and an oscillating cam drive apparatus arranged longitudinally displaceable on the drive shaft, which oscillating cam drive apparatus is drivingly connected to at least the second pressing member;

and comprising further one single cam disk which is firmly connected to the drive shaft, which cam disk is drivingly connected via a transmitting linkage arrangement to the first pressing member and to the first arresting member, as well, whereby the periodic movement for exerting a pressure by the first pressing member and the periodic movement for a clamped arresting by the first arresting member are controlled by said one single cam disk.

2. The apparatus of claim 1, wherein said transmitting linkage arrangement comprises a plurality of linkage members of which each linkage member features a lever arm length, by means of which lever arm lengths a respective distance between said first pressing member and said second pressing member and a respective distance between said first arresting member and said second arresting member are set, and wherein the lever arm lengths of the individual linkage members of the transmitting linkage arrangement are selected in such a manner that influences of the operation of the first pressing member and the first arresting member onto the strip-like workpiece occur independent from the thickness of a respective strip-like workpiece being fed.

3. The apparatus of claim 1, wherein said transmitting linkage arrangement is adapted to control said first pressing member and said first arresting member into an intermediate lifted position during which said first pressing member and said first arresting member are simultaneously lifted off the strip-like web, and wherein the feeding apparatus comprises an adjustable abutment member adapted to cooperate with the transmitting linkage arrangement allowing a simultaneous adjusting of the distance between the two pressing members and between the two arresting members during the state of said intermediate lifted position.

4. The apparatus of claim 1, comprising a roller which rests against the single cam disk and is spring biased against the single cam disk, which roller is supported in an angle lever which is supported to pivot around a stationary pivotal point, comprising further a first link member which is pivotally mounted to the angle lever and is in turn pivotally mounted to a main arm at a first pivotal point, further comprising a second link member which is pivotally mounted to the main arm at a second pivotal point located at a distance a from the first pivotal point and is pivotally mounted at a third pivotal point to a first double arm lever which is supported at a first bearing point, which third pivotal point is located at a second distance c from the first bearing point, which double arm lever is mounted at a fourth pivotal point to the first pressing member, which fourth pivotal point is located at a distance d from the first bearing point and comprising a third link member which is pivotally mounted to the main arm at a fifth pivotal point which is located at a fourth distance b from the first pivotal point and is pivotally mounted at a sixth pivotal point to a second double arm lever which is supported at a second bearing point, which sixth pivotal point is located at a fifth distance e from the second bearing point, which second double arm lever is mounted at a seventh pivotal point to the first arresting member, which seventh pivotal point is located at a distance f from the second bearing point, where distances:

$$\frac{a \times d}{c} = \frac{b \times f}{e}.$$

5. An apparatus for stepwise feeding of a strip-like workpiece, the apparatus comprising:

first and second pressing members co-operating to receive a strip-like workpiece between them for stepwise clamping and feeding of the strip-like workpiece;

first and second arresting members for arresting the strip-like workpiece alternately with the stepwise clamping and feeding;

a rotatable drive shaft;

an oscillating cam drive apparatus longitudinally displaceable on the drive shaft and drivingly connected to the second pressing member;

only one single cam disk connected to the drive shaft for rotation therewith; and a transmitting linkage drivingly connecting the one single cam disk to the first pressing member and to the first arresting member for the stepwise clamping and feeding and arresting of the strip-like workpiece by the one single cam disk.

* * * * *